US011435105B2

(12) United States Patent
Liu et al.

(10) Patent No.: US 11,435,105 B2
(45) Date of Patent: Sep. 6, 2022

(54) AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Taisheng Liu, Foshan (CN); Weitao Xie, Foshan (CN); Zhiqiang Liu, Foshan (CN); Xianyou Mao, Foshan (CN); Shupeng Chen, Foshan (CN); Yuqi Ma, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 444 days.

(21) Appl. No.: 16/497,306

(22) PCT Filed: Apr. 25, 2019

(86) PCT No.: PCT/CN2019/084325
§ 371 (c)(1),
(2) Date: Sep. 24, 2019

(87) PCT Pub. No.: WO2020/177203
PCT Pub. Date: Sep. 10, 2020

(65) Prior Publication Data

US 2021/0333002 A1 Oct. 28, 2021

(30) Foreign Application Priority Data

Mar. 6, 2019 (CN) ..... 201920286553.6

(51) Int. Cl.
*F24F 11/52* (2018.01)
*F24F 1/0087* (2019.01)
(Continued)

(52) U.S. Cl.
CPC ..... *F24F 11/52* (2018.01); *F24F 1/005* (2019.02); *F24F 1/0014* (2013.01);
(Continued)

(58) Field of Classification Search
CPC ..... F24F 11/52; F24F 11/523; F24F 1/005; F24F 1/0014; F24F 1/0071; F24F 1/0087;
(Continued)

(56) References Cited

U.S. PATENT DOCUMENTS

2006/0146908 A1* 7/2006 Remsburg ..... F24F 11/30 374/16
2009/0282853 A1* 11/2009 Lee ..... F24F 8/10 62/317
2019/0351357 A1* 11/2019 Bae ..... F24F 8/108

FOREIGN PATENT DOCUMENTS

CN 203240710 U 10/2013
CN 207279833 A 4/2018
(Continued)

OTHER PUBLICATIONS

Machine Translation of CN 108278668 (Year: 2018).*
(Continued)

*Primary Examiner* — Joseph F Trpisovsky
(74) *Attorney, Agent, or Firm* — Anova Law Group PLLC

(57) ABSTRACT

An air conditioner includes a housing. The housing includes a panel including an opening. The air conditioner further includes an indicator light arranged at the opening, an air heat exchange duct and an air treatment duct arranged in the housing and not in communication with each other, an air heat exchange device arranged at the air heat exchange duct and configured to conduct heat exchange for air in the air heat exchange duct, and an air treatment device arranged at the air treatment duct and configured to conduct at least one
(Continued)

of humidification or purification for air in the air treatment duct.

14 Claims, 4 Drawing Sheets

(51) Int. Cl.

| | |
|---|---|
| ***F24F 1/005*** | (2019.01) |
| ***F24F 1/0071*** | (2019.01) |
| ***F24F 1/0014*** | (2019.01) |
| ***F24F 13/20*** | (2006.01) |

(52) U.S. Cl.
CPC ..... *F24F 1/0071* (2019.02); *F24F 1/0087* (2019.02); *F24F 13/20* (2013.01); *F24F 2013/207* (2013.01); *F24F 2221/26* (2013.01)

(58) Field of Classification Search
CPC ... F24F 13/20; F24F 2013/207; F24F 2221/26
See application file for complete search history.

(56) References Cited

FOREIGN PATENT DOCUMENTS

| | | | |
|---|---|---|---|
| CN | 108266800 | A | 7/2018 |
| CN | 108278668 | A | 7/2018 |
| CN | 108278676 | A | 7/2018 |
| CN | 108895566 | A | 11/2018 |
| JP | 2002123200 | A | 4/2002 |
| KR | 20100079971 | A | 7/2010 |
| KR | 101809409 | B1 | 12/2017 |

OTHER PUBLICATIONS

Japan Patent Office (JPO) Notice of Reasons for Refusal for JP Application No. 2019-552484 dated Aug. 3, 2021 8 Pages (Translation Included).
The World Intellectual Property Organization (WIPO) International Search Report and Written Opinion for PCT/CN2019/084325 dated Aug. 9, 2019 15 pages.
The European Patent Office (EPO) Extended Search Report for EP Application No. 19768996.1 dated Jun. 3, 2020 7 Pages.

* cited by examiner

Left—Right

Front—Rear

AIR CONDITIONER

CROSS-REFERENCE TO RELATED APPLICATIONS

The present application is a National Stage Entry under 35 U.S.C. § 371 of International Application No. PCT/CN2019/084325, filed on Apr. 25, 2019, which claims the priority of Chinese Patent Application No. 201920286553.6, filed in the Chinese Patent Office on Mar. 6, 2019, the entire contents of both of which are incorporated herein by reference.

FILED

The present application relates to the technical field of air conditioners, and particularly relates to an air conditioner.

BACKGROUND

For some users, it is difficult to accurately estimate the actual indoor condition, and thus it is difficult to properly and accurately set an air conditioner, so that the air conditioner cannot effectively perform the function of environmental conditioning. The problem of incorrect setting may even occur. For example, when the indoor temperature is low, a user incorrectly sets a cooling mode of the air conditioner, so that the air conditioner further reduces the indoor temperature, causing uncomfortable user experience.

SUMMARY

The present application aims to solve at least one of the technical problems in the existing technologies. To this end, the present application proposes an air conditioner which is powerful in functions and intuitively provides information for a user, so that the user more accurately controls the air conditioner.

The air conditioner according to embodiments of the present application comprises: a housing internally having an air heat exchange duct and an air treatment duct which are not in communication with each other; an air heat exchange device arranged at the air heat exchange duct for heat exchange for air in the air heat exchange duct; and an air treatment device arranged at the air treatment duct for humidifying and/or purifying the air in the air treatment duct, wherein the housing comprises a first panel; the first panel has an opening; and an indicator light is embedded at the opening.

The air conditioner according to embodiments of the present application is powerful in functions and intuitively provides information for the user, so that the user more accurately controls the air conditioner.

In some embodiments, the indicator light comprises a first part and a second part; the first part is matched in the opening; the second part is connected with the first part and is positioned at an inner side of the first panel; and a cross section of the second part is larger than a cross section of the opening to prevent the indicator light from falling outwards from the opening.

In some embodiments, the inner side of the first panel has a limiting member; and the limiting member limits the indicator light to prevent the indicator light from falling inwards from the opening.

In some embodiments, the opening extends along a length direction of the first panel and is positioned at a central region of the first panel.

In some embodiments, the indicator light is a light strip; the opening is rectangular; and the length of the opening is more than 80 times of the width of the opening.

In some embodiments, the housing further comprises: a second panel and a third panel which are arranged at both sides of the first panel; at least one of the second panel or the third panel has a display control region; the air conditioner further comprises a display control device; the display control device is embedded in the display control region or positioned at the inner side of the display control region; and the indicator light is electrically connected with the display control device.

In some embodiments, the housing further comprises: a second panel and a third panel which are arranged at both sides of the first panel; the housing further comprises: a second casing arranged at a rear side of the second panel and spliced with the second panel into a first housing part, wherein the air heat exchange device is arranged in the first housing part; and a third casing arranged at a rear side of the third panel and spliced with the third panel into a second housing part, wherein the air treatment device is arranged in the second housing part.

In some embodiments, the air conditioner further comprises a middle support device; the middle support device is supported between the air heat exchange device and the air treatment device; the housing further comprises: a middle housing part encircling the middle support device by one circle and spliced between the second casing and the third casing; the first panel encircles the middle housing part by less than one circle on the outer side of the middle housing part, and is spliced between the second panel and the third panel.

In some embodiments, the first housing part is positioned above the second housing part; the first housing part has a first air outlet and a second air outlet; the first air outlet is in communication with the air heat exchange duct; the second air outlet is in communication with the air treatment duct; and part of the air treatment duct is formed by the middle support device.

In some embodiments, the middle housing part is a translucent member.

In some embodiments, the indicator light is electrically connected with the air heat exchange device to display the working state of the air heat exchange device by different colors.

In some embodiments, the air treatment device is at least used for purifying the air in the air treatment duct; the air conditioner further comprises an air quality detecting device; and the indicator light is electrically connected with the air quality detecting device to display indoor air quality detected by the air quality detecting device by different colors.

In some embodiments, the air treatment device is at least used for humidifying the air in the air treatment duct; the air conditioner further comprises an air humidity detecting device; and the indicator light is electrically connected with the air humidity detecting device to display indoor air humidity detected by the air humidity detecting device by different colors.

Additional aspects and advantages of the present invention will be provided partly in the following description, which will become apparent from the following description or will be known through the practice of the present application.

Figure 1:
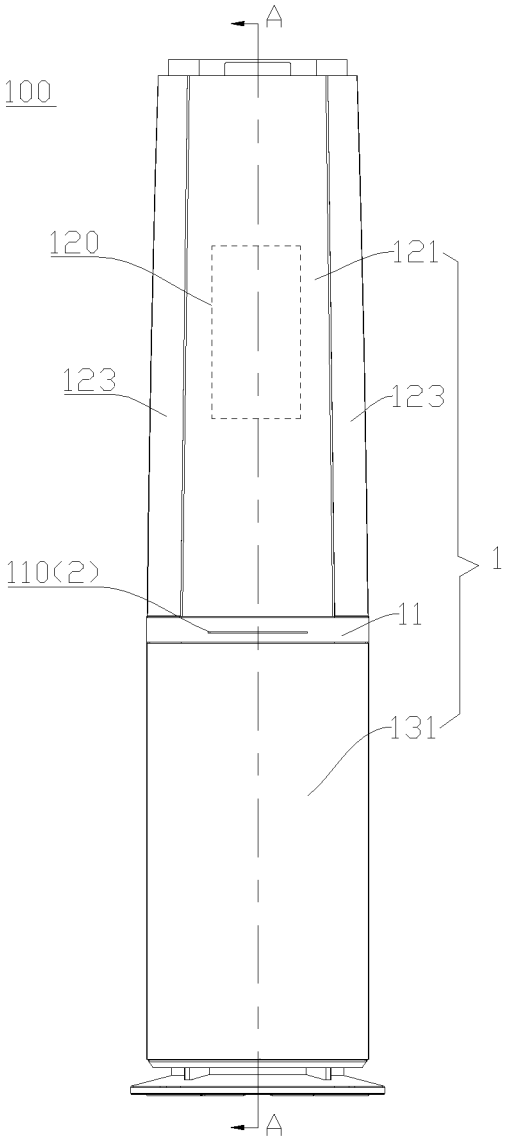
FIG. 1 is a front view of an air conditioner according to an embodiment of the present application.

List of reference numerals: air conditioner 100; housing 1; air heat exchange duct 101; air treatment duct 102; first panel 11; opening 110; first housing part 12; second panel 121; second casing 122; display control region 120; first air outlet 12*a*; second air outlet 12*b*; switch door 123; second housing part 13; third panel 131; third casing 132; middle housing part 14; indicator light 2; first part 21; second part 22; limiting member 3; air heat exchange device 4; air treatment device 5; middle support device 6; display control device 7; air quality detecting device 8; air humidity detecting device 9.

DETAILED DESCRIPTION OF THE EMBODIMENTS

Embodiments of the present application will be described below in detail. Examples of the embodiments are shown in drawings, wherein same or similar reference signs refer to same or similar members or members having same or similar functions from beginning to end. The embodiments described below by reference to the drawings are exemplary embodiments, and are intended to explain the present application, and shall not be understood as a limitation to the present application.

The following disclosure provides many different embodiments or examples for realizing different structures of the present application. In order to simplify the disclosure of the present application, the components and arrangement of specific examples are described below. Of course, they are merely examples and are not intended to limit the present application. In addition, the present application can repeat reference numbers and/or reference letters in different examples. This repetition is for the purpose of simplicity and clarity, and does not indicate the relationship among the discussed embodiments and/or arrangements. Furthermore, the present application provides examples of various specific processes and materials, but those ordinary skilled in the art can recognize the application of other processes and/or the use of other materials.

An air conditioner 100 according to embodiments of the present application will be described below. It should be noted that the type of the air conditioner 100 according to the embodiments of the present application is not limited, and may be, for example, a split wall-mounted air conditioner, a split floor type air conditioner, a mobile air conditioner or a window air conditioner.

Figure 2:
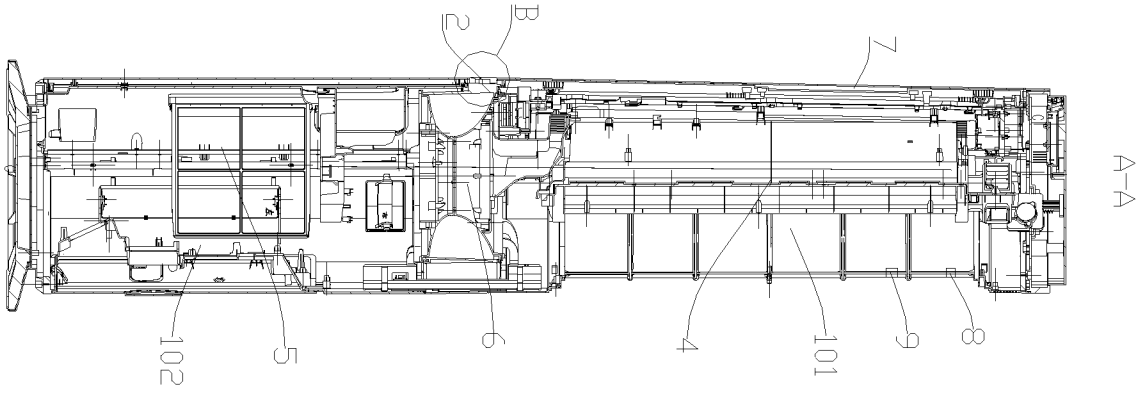
FIG. 2 is a sectional view along A-A line in FIG. 1.

As shown in FIG. 1 and FIG. 2, the air conditioner 100 according to the embodiments of the present application may include (but not limited to) a housing 1, an air heat exchange device 4 and an air treatment device 5, wherein the housing 1 internally has an air heat exchange duct 101 and an air treatment duct 102 which are not in communication with each other. Namely, the air heat exchange duct 101 and the air treatment duct 102 are independent of each other. After the air outside the housing 1 enters the air heat exchange duct 101, the air does not flow into the air treatment duct 102 from the air heat exchange duct 101. After the air outside the housing 1 enters the air treatment duct 102, the air does not flow into the air heat exchange duct 101 from the air treatment duct 102.

As shown in FIG. 2, the air heat exchange device 4 is arranged at the air heat exchange duct 101 (i.e., at least part of the air heat exchange device 4 is arranged in the air heat exchange duct 101) for heat exchange of the air in the air heat exchange duct 101. Namely, after the air outside the housing 1 enters the air heat exchange duct 101, the air can exchange heat with the air heat exchange device 4 to heat the air into high temperature air or cool the air into low temperature air, and then is discharged from the air heat exchange duct 101 to the outside of the housing 1, so as to adjust the ambient air temperature. Thus, the air conditioner 100 according to the embodiments of the present application has the function of adjusting air temperature. It can be understood that, for the air conditioner 100, the specific configuration of the air heat exchange device 4 that can exchange heat with the air is well known by those skilled in the art. For example, the air heat exchange device 4 may include a heat exchanger and the like. In addition, the air heat exchange device 4 may further include a fan for the air heat exchange duct 101 to introduce an airflow.

As shown in FIG. 2, the air treatment device 5 is arranged at the air treatment duct 102 (i.e., at least part of the air treatment device 5 is arranged in the air treatment duct 102) for humidifying and/or purifying the air in the air treatment duct 102. Namely, after the air outside the housing 1 enters the air treatment duct 102, the air may be humidified by the air treatment device 5, or purified by the air treatment device 5, or humidified by the air treatment device 5 and also purified by the air treatment device 5, and then is discharged from the air treatment duct 102 to the outside of the housing 1, so as to adjust the ambient air humidity and/or quality. Thus, the air conditioner 100 according to the embodiments of the present application has the function of adjusting air humidity and/or quality.

It can be understood that, for the air conditioner 100, the specific configuration of the air treatment device 5 that humidifies the air is well known by those skilled in the art. For example, the air treatment device 5 may include a wet film, a wet curtain, a water wheel, an ultrasonic generator, and the like. The specific configuration of the air treatment device 5 that can purify the air is well known by those skilled in the art. For example, the air treatment device 5 may include a high efficiency air filter, activated carbon, a photocatalyst, a negative ion generator, and the like. In addition, when the air treatment device 5 includes the wet film or the water wheel, the air treatment device 5 can humidify the air and can purify the air by using water droplets. In addition, the air treatment device 5 may further include a fan for the air treatment duct 102 to introduce an airflow.

Thus, the air conditioner 100 according to the embodiments of the present application has a powerful function, and an air conditioner, a humidifier and a purifier are not required to be separately purchased. On one hand, the indoor space occupancy rate can be reduced, and on the other hand, the cost can be reduced.

Figure 3:
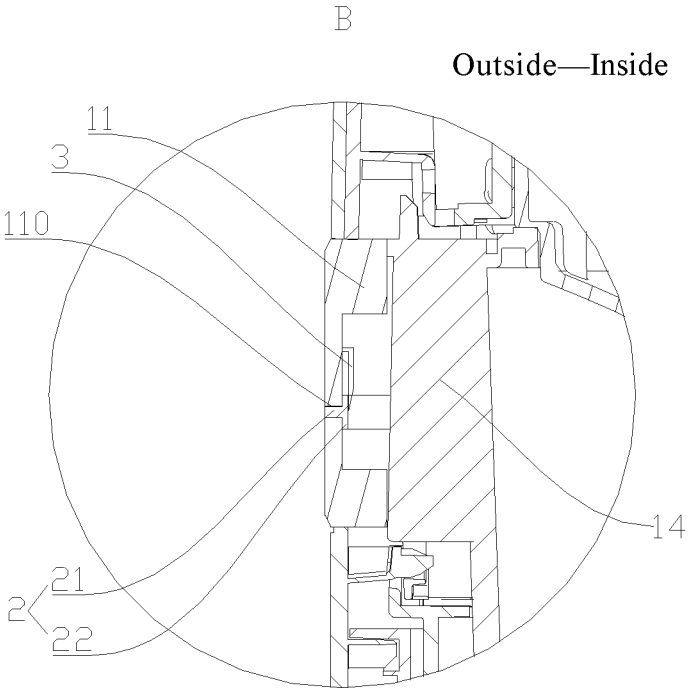
FIG. 3 is an enlarged view of part B circled in FIG. 2.

As shown in FIG. 1 and FIG. 3, in the air conditioner 100 according to the embodiments of the present application, the housing 1 comprises a first panel 11; the first panel 11 has an opening 110; and an indicator light 2 is embedded at the opening 110. Namely, at least part of the indicator light 2 is positioned in the opening 110.

Thus, the indicator light 2 can cause the opening 110 of the first panel 11 to display light of different colors according to preset setting, thereby performing the function of indicating information. In this way, the user can intuitively receive the information given by the indicator light without the user being close to the air conditioner 100 to observe a display screen at the housing 1 of the air conditioner 100, or taking a remote controller to observe a display of the remote controller, so that the user can perform corresponding operation control on the air conditioner 100 according to the information, so as to switch the air conditioner 100 to an appropriate working state to perform an optimal environmental conditioning effect.

In short, in the air conditioner 100 according to the embodiments of the present application, with the indicator light 2 provided at the opening 110 of the first panel 11, more information can be intuitively provided for the user, so that the user can know the current working condition of the air conditioner 100 or the indoor environment at a glance without approaching the air conditioner 100 or without taking the remote controller. Thus, the user can control the air conditioner 100 more accurately, so that the air conditioner 100 presents an appropriate working state to perform an optimal environmental conditioning effect.

For example, in some embodiments of the present application, different colors displayed by the indicator light 2 can be used to indicate whether the air conditioner 100 is currently in a cooling state or a heating state. Specifically, in the present embodiment, the indicator light 2 can be electrically connected with the air heat exchange device 4, so that the working state of the air heat exchange device 4 can be displayed by different colors. For example, when the air heat exchange device 4 is in the heating working state, the indicator light 2 can display red (or warm colors such as orange); and when the air heat exchange device 4 is in the cooling working state, the indicator light 2 can display blue (or cool colors such as green). Herein, it should be noted that, in the present embodiment, the specific colors displayed by the indicator light 2 may be set according to actual requirements based on different working states of the air heat exchange device 4, and are not limited to red and blue described above.

Thus, the user can know the current working state of the air conditioner 100 by different colors displayed by the indicator light 2 to avoid misoperation. For example, when the indoor temperature is low and the indicator light 2 still displays blue, it indicates that the air conditioner 100 is in the cooling working state. This indicates that the user selects the incorrect working mode of the air conditioner 100, and the user can correct the working mode selection of the air conditioner 100 in time and control the air conditioner 100 to change into the heating working state. At this time, the indicator light 2 is switched to display red, and the user knows that the working mode selection is corrected. At this time, the air conditioner 100 starts the heating work, and the indoor temperature can be increased.

For example, in some embodiments of the present application, different colors displayed by the indicator light 2 can be used to indicate the quality of the indoor air. Specifically, in the present embodiment, the air treatment device 5 is at least used for purifying the air in the air treatment duct 102; the air conditioner 100 may further include an air quality detecting device 8; and the indicator light 2 is electrically connected with the air quality detecting device 8 to display the indoor air quality detected by the air quality detecting device 8 by different colors. For example, when the air quality detected by the air quality detecting device 8 is poor, the indicator light 2 can display red; when the air quality detected by the air quality detecting device 8 is moderate, the indicator light 2 can display blue; and when the air quality detected by the air quality detecting device 8 is good, the indicator light 2 can display green.

Thus, the user can know the current indoor air quality through different colors displayed by the indicator light 2 to control the working state of the air treatment device 5 according to the indoor air quality. For example, when the indoor air quality is poor, the indicator light 2 displays red. At this time, the user can select a purifying working mode to enable the air treatment device 5 to start working, or increase the purifying degree of the purifying working mode so that the indoor air quality is improved as soon as possible. When the indicator light 2 changes to display blue or green, it indicates that the indoor air quality is improved. At this time, the user can reduce the purifying degree of the purifying working mode or turn off the purifying working mode to achieve an energy saving effect.

Herein, it should be noted that, in the present embodiment, the specific colors displayed by the indicator light 2 may be set according to actual requirements based on different air quality, and are not limited to red, green and blue described above. Moreover, a specific value through which the air quality detecting device 8 judges whether the indoor air quality is good or bad may be set according to actual conditions (for example, when the air conditioner 100 is used in different countries or regions). For example, the detection parameter of the air quality detecting device 8 and the reference value for judging the air quality can be set according to the national standard.

For example, in some embodiments of the present application, different colors displayed by the indicator light 2 can be used to indicate the humidity of the indoor air. Specifically, in the present embodiment, the air treatment device 5 is at least used for humidifying the air in the air treatment duct 102; the air conditioner 100 may further include an air humidity detecting device 9; and the indicator light 2 is electrically connected with the air humidity detecting device 9 to display the indoor air humidity detected by the air humidity detecting device 9 by different colors. For example, when the air humidity detected by the air humidity detecting device 9 is high, the indicator light 2 can display green, which indicates that the indoor air is humid; when the air humidity detected by the air humidity detecting device 9 is low, the indicator light 2 can display yellow, which indicates that the indoor air is dry; and when the air humidity detected by the air humidity detecting device 9 is proper, the indicator light 2 can display blue, which indicates that the indoor humidity is proper.

Thus, the user can know the current indoor air humidity through different colors displayed by the indicator light 2 to control the working state of the air treatment device 5 according to the indoor air humidity. For example, when the indoor air humidity is low, it indicates that the indoor air is humid and the indicator light 2 displays yellow. At this time, the user can select the humidifying working mode to enable the air treatment device 5 to start working, or increase the humidifying degree of the humidifying working mode so that the indoor air humidity is increased as soon as possible. When the indicator light 2 changes to display green, it indicates that the indoor air humidity is high and the indoor air is humid. At this time, the user can turn off the humidifying working mode to avoid further increasing the indoor humidity. When the indicator light 2 changes to display blue, it indicates that the indoor air humidity is proper. At this time, the user can turn off the humidifying working mode to achieve an energy saving effect.

Herein, it should be noted that, in the present embodiment, the specific colors displayed by the indicator light 2 may be set according to actual requirements based on different humidity, and are not limited to green, yellow and blue described above. Moreover, a specific value through which the air humidity detecting device 9 judges whether the indoor air humidity is high or low may be set according to actual conditions (for example, when the air conditioner 100 is used in different regions, such as in the north and the south in China). For example, the detection parameter of the air humidity detecting device 9 and the reference value for judging the air humidity can be set according to the national standard.

In addition, the user can set according to the actual needs: different colors displayed by the indicator light 2 are used to indicate the humidity of the indoor air, or to indicate the quality of the indoor air, or to indicate whether the air conditioner 100 is currently in the cooling state or the heating state. In addition, the opening 110 may further include a plurality of sub-openings, and the indicator light 2 comprises sub-lights respectively arranged at each sub-opening. One sub-light may indicate the humidity of the indoor air according to different displayed colors; another sub-light can indicate the quality of the indoor air according to different displayed colors; and another sub-light can indicate whether the air conditioner 100 is currently in the cooling state or the heating state according to different displayed colors.

In some embodiments of the present application, as shown in FIG. 3, the indicator light 2 comprises a first part 21 and a second part 22; the first part 21 is matched in the opening 110; the second part 22 is connected with the first part 21 and is positioned at an inner side of the first panel 11; and a cross section of the second part 22 is larger than a cross section of the opening 110 to prevent the indicator light 2 from falling outwards from the opening 110. Herein, it should be noted that "outer" described herein refers to a side distal from the center of the housing 1. Thus, the indicator light 2 is made into the above shape, so as to simply and effectively prevent the indicator light 2 from falling outwards from the opening 110, and facilitate the installation of the indicator light 2 and the first panel 11. Namely, during assembly, the indicator light 2 is mounted from inside to the outside to clamp the first part 21 into the opening 110, so that the second part 22 abuts against the inner surface of the first panel 11, and the indicator light 2 and the first panel 11 are assembled in place, thereby increasing assembly efficiency and eliminating other positioning structures. Of course, the present application is not limited to this, and the indicator light 2 can also be made into other more complicated shapes which are not described herein.

In some embodiments of the present application, as shown in FIG. 3, the inner side of the first panel 11 has a limiting member 3; and the limiting member 3 limits the indicator light 2 to prevent the indicator light 2 from falling inwards from the opening 110. Herein, it should be noted that "inner" described herein refers to a side proximal to the center of the housing 1. Thus, the limiting member 3 is arranged so as to prevent the indicator light 2 from moving inwardly away from the opening 110 when the user presses the indicator light 2 from the outside to the inside by mistake, thereby improving the assembly reliability of the indicator light 2. It can be understood that many limiting members 3 having the above limiting function are optional, such as a tape, a rotary lock catch and the like, which is not limited herein. Of course, the present application is not limited to this, and in other embodiments of the present application, the limiting member 3 can also be omitted. For example, when the air conditioner 100 further comprises the middle housing part 14 to be described later, the inner end of the indicator light 2 (i.e., an end proximal to the center of the housing 1) can abut against the outer surface of the middle housing part 14, so that the indicator light 2 can be simply and effectively prevented from falling inwards from the opening 110.

In some embodiments of the present application, the indicator light 2 may be a light strip. Thus, the light strip is convenient to acquire, low in cost, easy in replacement and maintenance, difficult to damage and long in service life and satisfies multi-color display requirements. Moreover, the light strip has low power consumption and good energy saving effect. Of course, the present application is not limited to this, and the indicator light 2 may also be configured in other structural forms. For example, in a specific example of the present application, the indicator light 2 may further include a glass housing and a light source arranged in the glass housing, which is not repeated herein.

Figure 4:
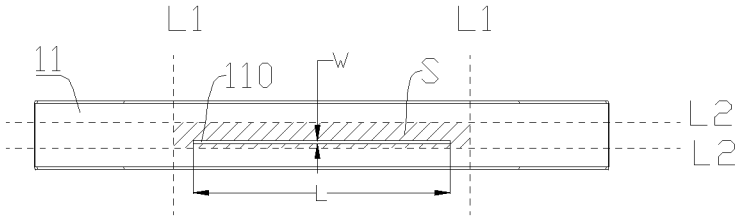
FIG. 4 is an enlarged view of a first panel shown in FIG. 1.

In addition, to match with the use of the indicator light 2 as the light strip, as shown in FIG. 4, the opening 110 may be rectangular; and the length L of the opening 110 may be more than 80 times the width W of the opening 110, i.e., $L \geq 80W$. Thus, the light strip can be effectively filled in the opening 110, and since the opening 110 is linear, a wide range of light is not generated. When the air conditioner 100 is used at night, the light of the indicator light 2 does not affect the normal rest of the user, and the energy saving effect is good.

In some embodiments of the present application, as shown in FIG. 4, the opening 110 extends along a length direction of the first panel 11. Namely, the length direction of the opening 110 is the same as the length direction of the first panel 11 (e.g., the left-right direction shown in FIG. 4); and the opening 110 is positioned at a central region S of the first panel 11, wherein the central region S means that: the length of the first panel 11 is equally divided into three parts, and two first trisection lines L1 are made; the width of the first panel 11 is equally divided into three parts, and two second trisection lines L2 are made; and the central region at the intersections of the two first trisection lines L1 and the two second trisection lines L2 is the central region S of the first panel (as shown by a shadow region in FIG. 4). Thus, the indicator light 2 can make full use of the space of the first panel 11 for indication, and the position of the indicator light 2 is conspicuous and easy to be noticed by the user. In addition, since the opening 110 is centered, the processing and the assembly of the indicator light 2 are facilitated.

In some embodiments of the present application, as shown in FIG. 1, the housing 1 may further comprise a second panel 121 and a third panel 131 which are arranged at both sides of the first panel 11 respectively. For example, when the air conditioner 100 is a vertical air conditioner, the second panel 121 and the third panel 131 may be respectively positioned at the upper side and the lower side of the first panel 11; and for example, when the air conditioner 100 is a transverse air conditioner, the second panel 121 and the third panel 131 may be respectively positioned at the left side and the right side of the first panel 11 (this example is not shown in the figure).

As shown in FIG. 1 and FIG. 2, at least one of the second panel 121 or the third panel 131 has a display control region 120; the air conditioner 100 further comprises a display control device 7; the display control device 7 is embedded in the display control region 120 or positioned at the inner side of the display control region 120. Namely, when the display control region 120 is a perforated region, the display control device 7 can be embedded in the display control region 120 so as to be directly contacted by the user; and when the display control region 120 is an entity region (including a groove region and a flat region), the display control device 7 may be positioned at the inner side of the display control region 120 so as to be hidden on the inner side of the display control region 120 to avoid direct contact by the user. It can be understood that the display control device 7 has a display function (for example, including a display screen) and a triggered function (for example, including a touch screen or a button, etc.).

Thus, according to the air conditioner 100 of the embodiment of the present application, the information can be fed back to the user through the display control device 7 of the display control region 120, and a user instruction can be accepted, wherein the indicator light 2 can be electrically connected with the display control device 7. For example, a lead wire of the indicator light 2 can be plugged to a circuit board of the display control device 7. Thus, since the first panel 11 and the second panel 121 are closer to the third panel 131, the distance between the indicator light 2 and the display control device 7 is relatively short. The lead wire of the indicator light 2 is connected to the circuit board of the display control device 7 to shorten the lead wire of the indicator light 2, so that the wire of the air conditioner 100 is clean and simple, and the reliability and the safety of the wire are improved.

Figure 5:
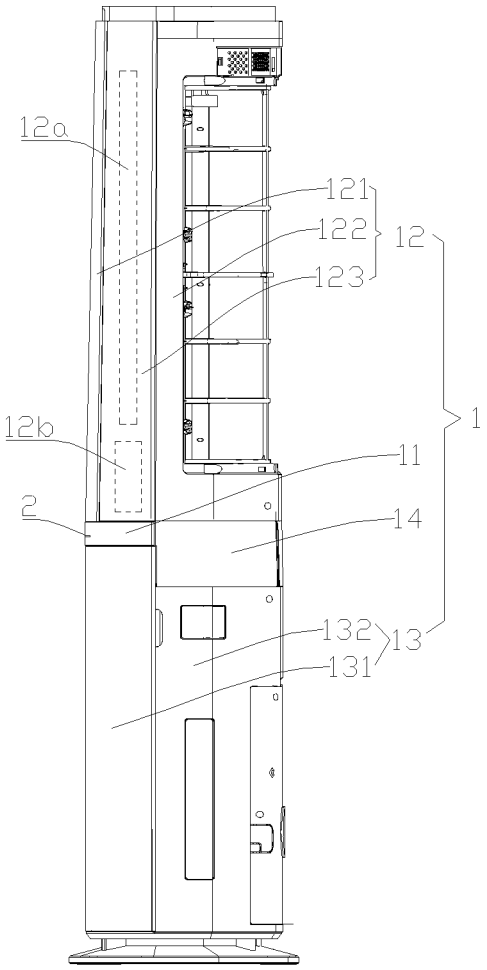
FIG. 5 is a right view of an air conditioner shown in FIG. 1.

In some embodiments of the present application, as shown in FIG. 1 and FIG. 5, when the housing 1 comprises a second panel 121 and a third panel 131 and the second panel 121 and the third panel 131 are respectively arranged at both sides of the first panel 11, the housing 1 may further comprise: a second casing 122 and a third casing 132, and the second casing 122 is arranged at a rear side of the second panel 121 and spliced with the second panel 121 into a first housing part 12. The air heat exchange device 4 is arranged in the first housing part 12; and the third casing 132 is arranged at a rear side of the third panel 131 and spliced with the third panel 131 into a second housing part 13. The air treatment device 5 is arranged in the second housing part 13. It should be noted that the "rear side" described herein refers to a side of the air conditioner 100 that faces away from the user in normal use, and an opposite side is the "front side", i.e., a side of the air conditioner 100 facing the user in normal use.

Thus, the structure of the air conditioner 100 is simple and convenient for processing and assembly. Since the first panel 11 is positioned between the second panel 121 and the third panel 131, the indicator light 2 can be positioned or substantially positioned between the first housing part 12 and the second housing part 13, thereby indicating that the indicator light 2 is positioned in the center position of the entire air conditioner 100. The arrangement position is conspicuous and easy to be observed by the user. In addition, it should be noted that the "splicing" described herein shall be understood in broad sense, and may include direct connection and indirect connection.

In some embodiments of the present application, as shown in FIG. 2 and FIG. 5, the air conditioner 100 further comprises a middle support device 6; the middle support device 6 is supported between the air heat exchange device 4 and the air treatment device 5; the housing 1 may further comprise a middle housing part 14 encircling the middle support device 6 by one circle and spliced between the second casing 122 and the third casing 132; the first panel 11 encircles the middle housing part 14 by less than one circle on the outer side of the middle housing part 14, and is spliced between the second panel 121 and the third panel 131.

Thus, in the air conditioner 100 of this structure, the user can see from the front side the second panel 121, the first panel 11 and the third panel 131 which are sequentially spliced, and the user can see from the rear side the second casing 122, the middle housing part 14 and the third casing 132 which are sequentially spliced. At this time, the housing 1 has a simple structure, and is convenient in processing and assembly. In addition, the middle support device 6 is arranged, so as to reliably position the relative positions of the air heat exchange device 4 and the air treatment device 5. In some specific examples of the present application, the middle housing part 14 may be a translucent member. At this time, the user can observe the middle support device 6 inside the air conditioner 100 from the rear side through the middle housing part 14.

In some embodiments of the present application, as shown in FIG. 2 and FIG. 5, the first housing part 12 is positioned above the second housing part 13; the first housing part 12 has a first air outlet 12*a* and a second air outlet 12*b*; the first air outlet 12*a* is in communication with the air heat exchange duct 101; the second air outlet 12*b* is in communication with the air treatment duct 102; and part of the air treatment duct 102 is formed by the middle support device 6. Thus, the air heat exchange device 4 in the first housing part 12 can directly supply air outwards through the first air outlet 12*a* on the first housing part 12, and the air treatment device 5 in the second housing part 13 can supply the airflow to the first housing part 12 through the middle support device 6, so as to supply the air outwards through the second air outlet 12*b* on the first housing part 12, thereby ensuring the air supply height of the air heat exchange duct 101 and the air supply height of the air treatment duct 102, so as to improve the air conditioning effect of the air conditioner 100.

In addition, as shown in FIG. 1 and FIG. 5, in the air conditioner 100 according to the embodiments of the present application, the first housing part 12 may further comprise a switch door 123 and the like for opening and closing the first air outlet 12*a* and the second air outlet 12*b*. In addition, it can be understood that, in the air conditioner 100 according to the embodiments of the present application, the housing 1 may further have a first air inlet in communication with the air heat exchange duct 101 and a second air inlet in communication with the air treatment duct 102; and the second air inlet can be an indoor machine air inlet and/or a ventilation inlet, etc. In addition, other configurations (such as a compressor) and operating principles of the air conditioner 100 according to the embodiments of the present application are well known by those skilled in the art, and are not described herein.

In the illustration of the present application, it should be understood that the terms such as "first", "second" and "third" are only used for the purpose of description, rather than being understood to indicate or imply relative importance or hint the number of indicated technical features. Thus, the feature limited by "first" and "second" can explicitly or impliedly comprise one or more of the features. In the explanation of the present application, the meaning of "a plurality of" is two or more unless otherwise clearly specified.

In the present application, unless otherwise specifically regulated and defined, terms such as "installation", "connected", "connecting", "fixation" and the like shall be understood in broad sense, and for example, may refer to direct connection or indirect connection through an intermediate medium or inner communication of two members or interaction relationship of two members. For those ordinary skilled in the art, the specific meanings of the above terms in the present application may be understood according to concrete conditions. In the present application, unless otherwise clearly specified and defined, a first feature is "above" or "below" a second feature may mean that the first feature and the second feature come into direct contact or the first feature and the second feature come into indirect contact through an intermediate medium.

In the illustration of this description, the illustration of reference terms such as "one embodiment", "some embodiments", "example", "specific example" or "some examples", etc. means that specific features, structures, materials or characteristics illustrated in combination with the embodiment or example are included in at least one embodiment or example of the present application. In this description, exemplary statements for the above terms are not necessarily intended for the same embodiment or example. Moreover, the described specific features, structures, materials or characteristics can be combined appropriately in any one or more embodiments or examples. In addition, those skilled in the art can combine and integrate different embodiments or examples and features of different embodiments or examples illustrated in this description without contradictory.

Although the embodiments of the present application have been shown and described, it will be appreciated for those ordinary skilled in the art that various changes, modifications, replacements and variations can be made to these embodiments without departing from the principle and spirit of the present application, and the scope of the invention is defined by the claims and the equivalent thereof.

What is claimed is:

1. An air conditioner, comprising:

a housing including:

a first panel including an opening;

a second panel;

a third panel, the second panel and the third panel being arranged at two sides of the first panel, respectively;

a first casing arranged at a rear side of the second panel and spliced with the second panel to form a first housing part; and a second casing arranged at a rear side of the third panel and spliced with the third panel to form a second housing part;

an indicator light arranged at the opening;

an air heat exchange duct and an air treatment duct arranged in the housing and not in communication with each other;

a heat exchanger arranged at the air heat exchange duct, accommodated in the first housing part, and configured to conduct heat exchange for air in the air heat exchange duct; and an air treatment device including at least one of a humidifier or a purifier, the air treatment device being arranged at the air treatment duct, accommodated by the second housing part, and configured to conduct at least one of humidification or purification for air in the air treatment duct;

wherein:

the first housing part is positioned above the second housing part and the first housing part includes:

a first air outlet in communication with the air heat exchange duct; and a second air outlet in communication with the air treatment duct.

2. The air conditioner according to claim 1, wherein the indicator light comprises:

a first part inserted in the opening; and a second part connected with the first part and positioned at an inner side of the first panel, a cross section of the second part being larger than a cross section of the opening in at least one dimension.

3. The air conditioner according to claim 1, further comprising:

a limiting member arranged at the inner side of the first panel and being configured to limit the indicator light to prevent the indicator light from falling inwards from the opening.

4. The air conditioner according to claim 1, wherein the opening extends along a length direction of the first panel and is positioned at a central region of the first panel.

5. The air conditioner according to claim 1, wherein:

the indicator light includes a light strip; and the opening is rectangular, a length of the opening being more than 80 times of a width of the opening.

6. The air conditioner according to claim 1, wherein:

at least one of the second panel or the third panel includes a display control region;

the air conditioner further comprising:

a display control device embedded in the display control region or positioned at an inner side of the display control region, the display control device being electrically connected with the indicator light.

7. The air conditioner according to claim 1, further comprising:

a middle support device supported between the heat exchanger and the air treatment device;

wherein:

the housing further comprises a middle housing part encircling the middle support device by one circle and spliced between the first casing and the second casing; and the first panel encircles the middle housing part by less than one circle on an outer side of the middle housing part, and is spliced between the second panel and the third panel.

8. The air conditioner according to claim 7, wherein part of the air treatment duct is formed by the middle support device.

9. The air conditioner according to claim 7, wherein the middle housing part includes a translucent member.

10. The air conditioner according to claim 1, wherein the indicator light is electrically connected with the heat exchanger to display a working state of the heat exchanger by different colors.

11. The air conditioner according to claim 1, wherein:

the air treatment device is at least configured to purify the air in the air treatment duct; and the indicator light is configured to display indoor air quality by different colors.

12. The air conditioner according to claim 1, wherein:

the air treatment device is at least configured to humidify the air in the air treatment duct; and the indicator light is configured to to display the indoor air humidity by different colors.

13. The air conditioner according to claim 1, wherein:

the opening penetrates the first panel from an inner side of the first panel to an outer side of the first panel, the outer side of the first panel being exposed to outside of the air conditioner; and the indicator light is at least partially arranged inside the opening.

14. The air conditioner according to claim 1, further comprising:

a middle support device supported between the heat exchanger and the air treatment device;

wherein:

the indicator light is at least partially arranged inside the opening; and the first panel encircles the middle support device.

* * * * *